US010167131B2

(12) United States Patent
Abrams

(10) Patent No.: US 10,167,131 B2
(45) Date of Patent: Jan. 1, 2019

(54) CONTENT DISPENSING CONTAINER APPARATUS

(71) Applicant: David Abrams, Highland Park, IL (US)

(72) Inventor: David Abrams, Highland Park, IL (US)

( * ) Notice: Subject to any disclaimer, the term of this patent is extended or adjusted under 35 U.S.C. 154(b) by 0 days.

(21) Appl. No.: 14/997,279

(22) Filed: Jan. 15, 2016

(65) Prior Publication Data

US 2016/0130069 A1 May 12, 2016

Related U.S. Application Data

(63) Continuation of application No. 13/723,719, filed on Dec. 21, 2012, now abandoned.

(51) Int. Cl.
*B65D 83/00* (2006.01)

(52) U.S. Cl.
CPC ..... *B65D 83/0027* (2013.01); *B65D 83/0005* (2013.01)

(58) Field of Classification Search
CPC ..... B65D 83/0027; B65D 83/005
See application file for complete search history.

(56) References Cited

U.S. PATENT DOCUMENTS 449,147 A * 3/1891 Welch ..... G01F 19/00 141/98
2,022,075 A * 11/1935 Cabrera ..... A45D 40/06 401/78
3,991,777 A * 11/1976 Powers ..... A45D 40/06 132/320
4,812,066 A * 3/1989 Gueret ..... A45D 40/06 401/78
5,143,464 A * 9/1992 Susini ..... A45D 40/06 401/69
5,538,161 A * 7/1996 Koehler ..... A45D 40/04 116/200
5,873,490 A * 2/1999 Walpole ..... B65D 83/0072 222/105
5,992,705 A * 11/1999 Lhuisset ..... A45D 40/04 222/386
6,769,302 B1 * 8/2004 King ..... G01F 19/00 73/426
7,410,106 B2 * 8/2008 Escoto, Jr. ..... B05B 7/2481 239/320
8,627,987 B2 * 1/2014 Pollack ..... B65D 83/0005 220/8
2009/0200309 A1 * 8/2009 Kosmyna ..... B05B 7/2408 220/495.02

(Continued)

*Primary Examiner* — Frederick C Nicolas
*Assistant Examiner* — Bob Zadeh
(74) *Attorney, Agent, or Firm* — Gurr Brande & Spendlove; David Noskowicz

(57) ABSTRACT

A content dispensing package apparatus is provided. The content dispensing package apparatus can be configured to elevate contents for immediate dispensing to the user, the user able to raise the contents from outside an outer container. For example, a container for dispensing edible contents can include a first container portion and a second container portion that is configured to move between a first position and a second position. By one approach the apparatus includes a tab coupled to the second container portion. The tab can be accessible from the outside of the container and used to move the second container.

15 Claims, 13 Drawing Sheets

(56) References Cited

U.S. PATENT DOCUMENTS

| | | | | |
|---|---|---|---|---|
| 2012/0074174 | A1* | 3/2012 | Pollack | B65D 83/0005 222/390 |
| 2015/0353265 | A1* | 12/2015 | Jethwani | B65D 83/005 222/328 |
| 2016/0130069 | A1* | 5/2016 | Abrams | B65D 83/0027 222/1 |

* cited by examiner

CONTENT DISPENSING CONTAINER APPARATUS

CROSS REFERENCE TO PRIOR APPLICATIONS

This application is a continuation of U.S. application Ser. No. 13/723,719, filed Dec. 21, 2012, which is incorporated by reference for all purposes.

BACKGROUND

Technical Field

This invention relates generally to content dispensing container and more particularly to preventing or at least mitigating unwanted depositing of container contents onto a user.

Background Art

Many devices have been developed to assist in the dispensing of contents, whether food or non-food related from it's packaging by hand. Various devices allow for access to the contents stored in containers or packaging for delivery to the end user.

Food containers, for snacks for example, are commonly used to package and dispense the contents directly to the user without any intermediate serving apparatus such as a plate or bowl. Typical containers however result in unwanted contents deposited on the user when trying to reach contents closer to the bottom of the container. In response, approaches have been identified offering a demonstrable ability to prevent the user from getting contents on the hands of the user by providing a movable platform.

Such approaches make use of a variety of methods that require relatively difficult and impractical solutions to the problem and in some cases are sufficiently complex that use issues can and do arise. Further these solutions lack a "fun" aspect to the product dispensation. The applicant has determined that existing approaches in these regards leave room for considerable improvement.

BRIEF DESCRIPTION OF THE DRAWINGS

The above needs are at least partially met through provision of the content dispensing apparatus described in the following detailed description, particularly when studied in conjunction with the drawings, wherein.

Figure 1:
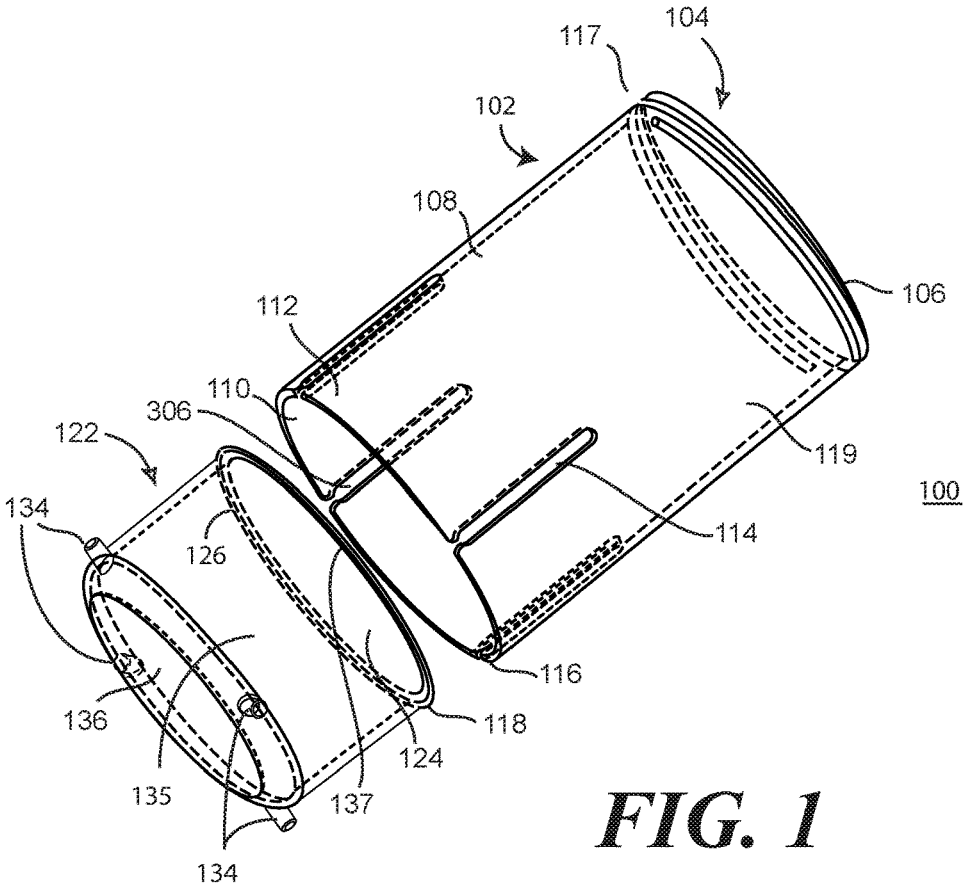
FIG. 1 comprises an exploded, perspective view of a container as configured in accordance with various embodiments of the invention.

Common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION OF THE DRAWINGS

Generally speaking, these various embodiments comprise a content dispensing container apparatus configured to be used by an end user of the content. This apparatus includes a plurality of containers configured to move relative to one another, allowing the contents to be elevated as they are dispensed. This allows the user to continuously access the contents while minimizing or even eliminating contact between the user's hand and the contents of the container, particularly when contents remain on the sides of the container.

One aspect of the apparatus allows for the control of the movement of an inner container from the outer surface of an outer container. Another aspect of the apparatus allows for rotational motion by the user to gain improved access to the contents, by way of a user-friendly configuration that result in a fun to use novelty product. Both, individually or in combination, minimize the opportunity for the contents to be undesirably transferred to the user's hand. These teachings are highly flexible and scalable in practice and can serve to greatly leverage a wide variety of existing dispensing container and packaging.

These and other benefits may become clearer upon making a thorough review and study of the following detailed description. Referring now to the drawings, various illustrative container apparatuses that are compatible with many of these teachings will be presented.

Embodiments of the invention are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figures other than figure A.

FIG. 1 illustrates a dispensing container 100, in exploded view, configured to elevate the contents for dispensing them throughout consumption, with a unique and convenient interaction by the user. The dispensing container 100 includes a first container 102 portion, having an opening 104 to access the contents of the container which may be at a top side 106 of the first container 102. The first container 102 may further include at least one side wall 108 and a bottom 116. The side wall 108 has an inner surface 110 and an outer surface 112 and at least one opening 114 through the side wall 108 and the opening may also extend through the bottom 116. The first container 102 includes threads 117 at the top opening 104 that couple to a lid (not shown).

The dispensing container 100 further comprises a second container 122 portion having an opening 124, to access the contents of the dispensing container 100 and eventually, as the contents are depleted, the contents remaining in the second container 122, through the opening 104 of the first container 102. The second container opening 124 may be at a top side 126 of the second container 122. The second container 122 may further comprise a side wall 135, a bottom 136, or may comprise only a bottom 136 without a side wall in some embodiments; wherein the contents are carried by the bottom as an elevator. The second container 122 portion is at least partially encompassed by the first container 102 portion and may be configured to move between a first position (FIG. 3), which may be a lowered position, and at least one second position (FIG. 5), which may be an elevated position. A grasp ring 410 (FIG. 4) is coupled to the second container 122 and accessible from outside of the container 100. This allows the second inner container 122 to be elevated from the outside of the first outer container 102.

The second container 122 may further comprise a seal 118, sealing an internal chamber 119 of the first and second container, which is the content containing portion of the dispensing container 100. This seal may isolate the contents from the environment. The seal 118 may be coupled to and extend around a perimeter of the second container 122 and may be configured at the top 126, and may be further adjacent the opening 124 of the second container 122. The seal 118 is configured such that it extends from the top 126, outward to an inner surface 110 of the first container 102, sealing any gap between the first container 102 inner surface 110 and the second container 122. In other embodiment, the seal may be one or more O-ring, for example, carried by one of the first container or the second container, sealing the interface between the two containers. The O-ring may be configured in an O-ring seat of the outer surface of the second container side wall 135 for example.

The seal 118 may be made of a food grade material of which those of ordinary skill in the art would understand to be effective in this application. Some typical materials include food grade urethane, such as polyurethane, food grade silicone or the like. The seal material is resilient so that it may maintain substantially consistent contact with the inner surface 110 of the first container 102 as the containers are moved relative to one another. The seal may also limit movement of the first container 104 relative to the second container 122. The size and fit of the seal may be such that under gravitational forces and the weight of the contents, the frictional force resulting from the seal is not overcome such that the second container 122 does not move down toward the bottom of the first container 102. In one embodiment, the seal 118 provides a sufficient force to hold the second container 122 at an elevated position, without the use of any further mechanical stops or indents integrated into either of the containers.

The dispensing container 100 further comprises a tab 134 coupled at least to the second container 122 portion and may project through the at least one opening 114 of the first container. In this embodiment, for example, the tab 134, projects through the side wall opening 114 of the side wall 108 of the first container 102. The tab 134 may be a protrusion, extending from the second container 122 such that it extends beyond the outer surface 112 of the first container 102. In some circumstances the tab 124 may not necessarily extend beyond the outer surface 112 but may at least be accessible from the outside of the container 102, while still coupled to the second container 122, such that the tab 124 is used to move the second container 122 relative to the first container 102. The tab may be formed as part of the second container, such as if the second container were molded as a unitary piece for example. The tab 134 may be a formed of an additional piece and added to the second container 122in a secondary process.

In this illustrative example the second container 122, containing at least a portion of the contents to be dispensed, may be movable relative to the first container 102, from outside of the first container, making the movement readily accessible to the user via the tabs. Put another way, the user does not need to reach inside or underneath the container in order to move the second inner container and elevate the contents; it is done from outside the container 100. This way the container does not need to be lifted in order to move the second inner container nor does the user have to reach inside the container, either from the top or the bottom in order to elevate the contents. For example, if the content is edible dip, the user does not want to have to pick up the container and push from underneath as this may be awkward and may lead to the contents spilling in the process. Nor does the user want to have to reach into the top of the container 100 to elevate the second inner container as there is a greater risk of getting the dip on the hands.

The tab 134, or protrusion which may be an extension of the second container 122, extends beyond the first container 102, whether it be through an opening 114 or void in the side wall or though some other access portion of the first container 102. These teachings will, however, accommodate other methods of moving the second container 122 relative to the first container 102, with other structural elements and configurations of the tab as understood to those of ordinary skill in the art.

Figure 2:
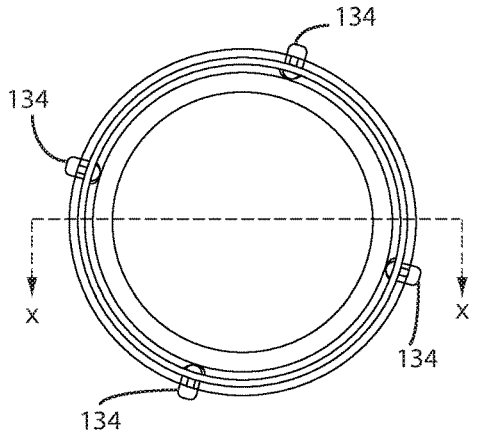
FIG. 2 comprises a top view as configured in accordance with various embodiments of the invention.
Figure 3:
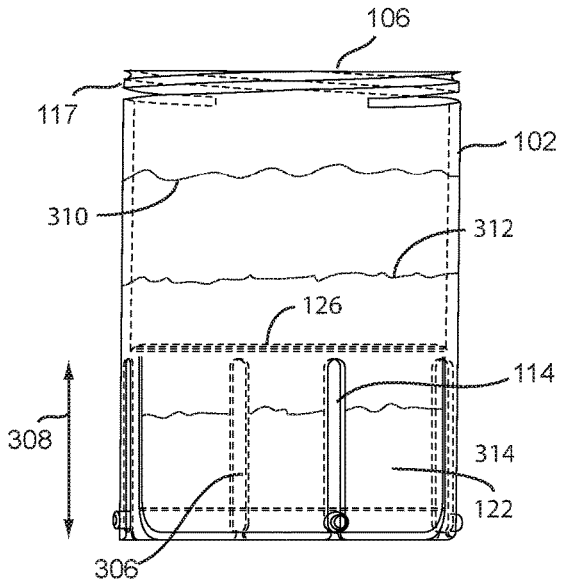
FIG. 3 comprises a front-elevation partial view as configured in accordance with various embodiments of the invention.

In one illustrative embodiment, a plurality of tabs 134 protrude from a surface of the second container 122 at different locations about the outer surface 112 of the second container. FIG. 2 in conjunction with FIG. 1 illustrates a top view of the container 100, with the second container 122 resident within the first container 102, showing the plurality of tabs. FIG. 3 illustrates a front elevation view, showing the tabs and their coincident openings, a first opening 114, of which there may be a plurality of openings, and a second opening 306 (shown in broken line as it is on the non visible side). In total there are four tabs and four complimentary openings, however for clarity only two are presently discussed.

While the tabs 134 and their complimentary openings 114, are presented as equally spaced and within the same plane, it is understood that they may not be equally spaced, and in different planes, and can in fact be paced different distances from one another. The complimentary set of openings in the first container that mate with the tabs, allow the second container 122 to move relative the first 102, positioning the contents of the dispensing container at a higher elevation relative to the opening 104 of the first container 102.

Also by way of example, in one embodiment the second container 122 may have only two tabs extending therefrom that are coincident with two openings in the first container 102. In this embodiment, the second opening 124 in the first container 102 is for receiving the second tab that is coupled to the second container 122 portion. In other examples, as discussed, the dispensing container comprises a plurality of openings in the side wall of the first container for receiving a plurality of tabs coupled at least to the second container portion.

In this illustrative embodiment, the openings 114 and 306 are configured as vertical slots in the side wall 108 of the first container 102, extending from the bottom 116 of the first container 102 to a first height 308 in the side wall 108 towards the top 106 of the first container 102. The vertical slots 114, 306 are linear in this embodiment however it is to be understood and as shown later, that the openings may take on various sizes, shapes and configurations.

Further illustrated in FIG. 3 are the contents of the container at various levels: a first high level 310, a second medium level 312 and a third lower level 314. As the contents are consumed the level of the content naturally lowers. At the first high level 310, the contents are contained within both the first container and the second container in this embodiment. When the content height reaches the third lower level, it is only contained within the second container. When the contents are too low, the user may adjust the level by raising the second container 122.

Figure 4:
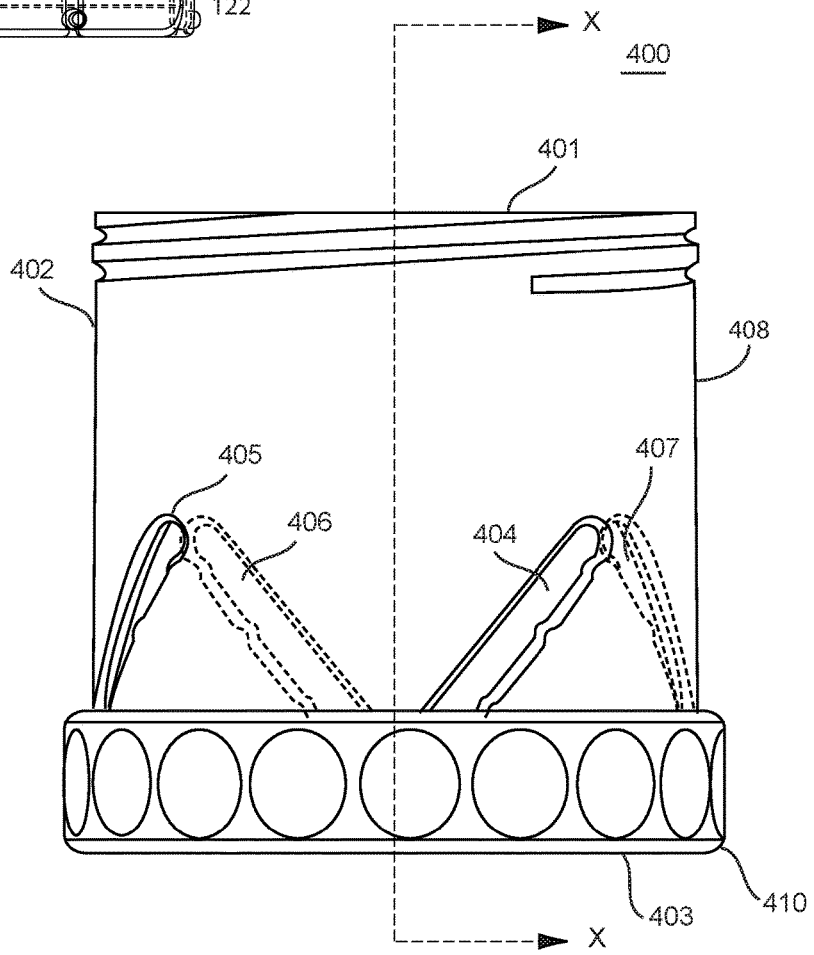
FIG. 4 comprises a front-elevation view as configured in accordance with various embodiments of the invention.

FIG. 4 illustrates another embodiment, where the openings are slots configured at an angle relative to the planes of the top 401 and the bottom 403 of the container 400. In this embodiment the first container 402 has four angled slots, a first angled slot 404, a second angled slot 405, third angled slot 406 and a fourth angled slot 407. In effect the slots spiral up the first container 402 side wall 408, which is cylindrical in this embodiment. Further shown in this embodiment, a grasp ring 410 that couples to the tabs, of similar nature to the tabs 134 illustrated in FIG. 1 and FIG. 2, effectively coupling the grasp ring 410 to the second container 122. This allows the user to grab onto the grasp ring 410 with one hand and the first container 402 with the other and twist the first container 402 relative the second container 122, simultaneously raising the second container 122, and hence the contents, toward the opening of the first container 402. It is to be understood that the grasp ring does not necessarily need to be a complete ring and in fact only needs to be a grasp member. The grasp member 410 may take on a plurality of configurations, so long as it allows the user to control the second container 122 from outside the container 100. The grasp member 410 is the user interface of the container 100, accessible from outside the container 100.

Figure 5:
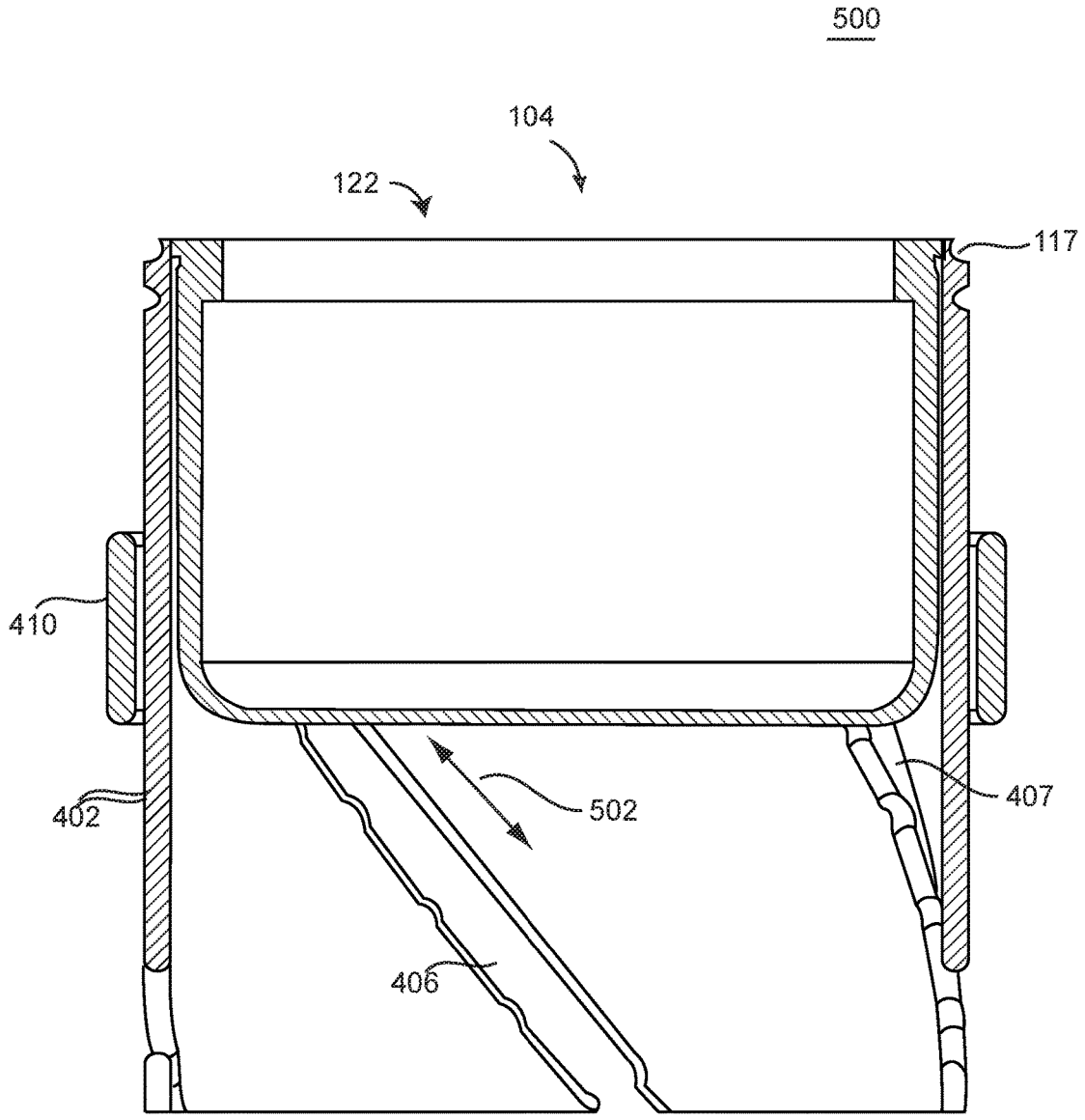
FIG. 5 comprises a front-elevation, cross sectional view as configured in accordance with various embodiments of the invention.

FIG. 5 illustrates the second container 122 in a second position 500, which is an elevated position in this embodiment, relative to the first container 402. The second container 122 is moves upward, as indicated by arrow 502, in a rotational manner towards the top of the first container 402. In this second position, 500, the contents are disposed closer to the opening 104 of the first container 102. The first container 402 and the second container 122 are configured such that a distance a user has to reach into the container, in order to reach the contents, is not greater than a maximum reach-in distance as discussed below. The maximum reach-in distance is a distance that minimizes the chance that a user's hand, or any portion thereof, will come in contact with the container walls or contents, unnecessarily depositing contents onto the user. The maximum reach in distance may be a function of the inner diameter of the container in one embodiment. Generally speaking as the inner diameter of the container increases, so does the maximum reach in distance as discussed below.

Figure 6:
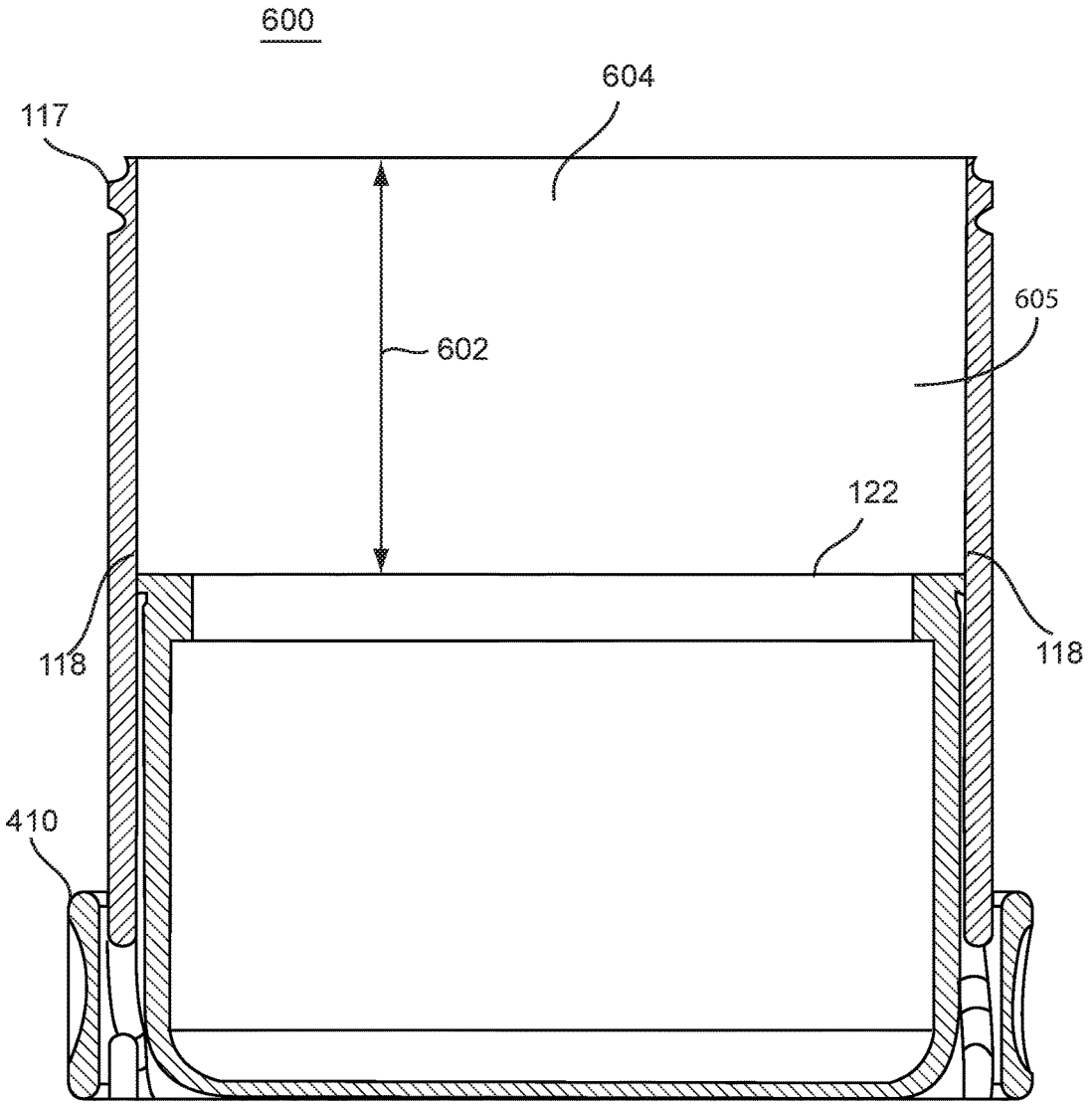
FIG. 6 comprises a front-elevation, cross sectional view as configured in accordance with various embodiments of the invention.

FIG. 6 illustrates the configuration of the first container relative to the second container, further showing the maximum reach-in distance 602. When the second container 122 is in the lowered position 600, the slots, whether linear or angled, or any other configuration, are completely covered by the second container 122 and below the seal 118. This ensures that the contents, particularly when it is food, are maintained in a sealed environment. In this embodiment the slots are therefore not exposed to the contents and the relative size of the containers ensure just such. The internal chamber 604 is within the first container 402 and second container 122, which is sealed off from the outside environment when the dispensing container is closed with a lid (not shown). It is to be understood that all components, such as the materials used for the container, the seal and the lid are of food grade quality. In the lowered position 600, when the container is full, the contents may fill the second container and the upper portion 605 of the first container 402, such that the both containers hold the contents.

The maximum reach-in distance 602 in one embodiment is between 1.0 (one) and 3.0 (three) inches and preferably 2.0 (two) inches. This maximum reach-in distance 602 is defined as the inner dimension of the second container 122, plus a hold back distance from the top of the first container. In other words, the second container may not elevate completely to the top, and may stop short a hold back distance for example. Once the contents fall below the maximum reach-in distance 602 the second container 122 may be elevated so that top portion of the contents remain above the maximum reach-in distance and closer to the top of the container.

In the various embodiments of the disclosure the dimensions of the portions may be as follows. The inner diameter of the first container is 3.0 (three) inches, and the overall container width, including the grasp ring 410 is 3.75 Inches. Coinciding with these container dimensions is a maximum reach-in distance of 2.0 inches. Of course the size of the container, and the corresponding reach-in distance, are scalable as consumers often desire to purchase the product in various sizes. As the size of the inner diameter is increased, so may be the maximum reach-in distance, in one embodiment. For example when the inner diameter of the container is 4.0 inches, the maximum reach-in may be 2.6 inches. It is to be contemplated that other sizes will follow this ratio. This may not necessarily be a completely linear relationship however. For example, when a container is made with an inner diameter greater than a first predetermined inner diameter, the reach-in distance will not increase further at the same rate or at all as when the inner diameter is less than the first predetermined inner diameter. In other words once the container opening size reaches a certain diameter, the relationship with the maximum reach in distance changes because most hand widths are not greater than a certain width and the opportunity for the hand to touch the side of the container diminishes.

Figure 7:
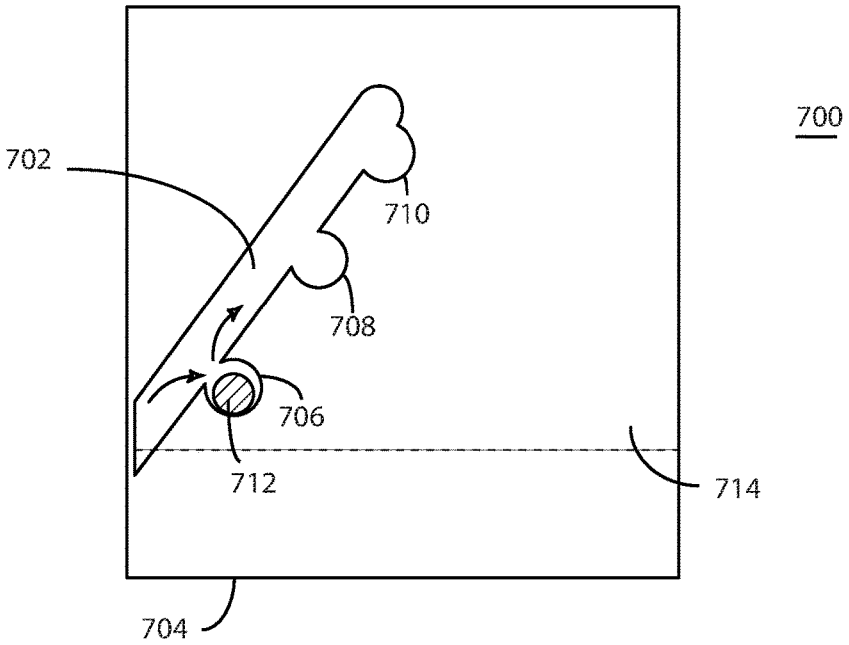
FIG. 7 comprises an exploded, perspective view of a container as configured in accordance with various embodiments of the invention.

FIG. 7 illustrates a dispensing container 700 that incorporates at least one slot 702, in the side of the first container. The slot may further comprise at least one indent 706, spaced from the bottom 704 of the container along the slot 702. The indent 706 is configured to selectively retain a coinciding tab 712 of the second container 714. In this embodiment three indents are shown, a first indent 706 *a* second indent 708 and a third indent 710 and it is to be understood that there may be more or less indents than those shown. For example a very wide shallow container may only need one indent to hold the second container to an elevated position. Although not shown, there may be an indent to hold the container in the lowest position at the bottom of the first container.

Figure 8:
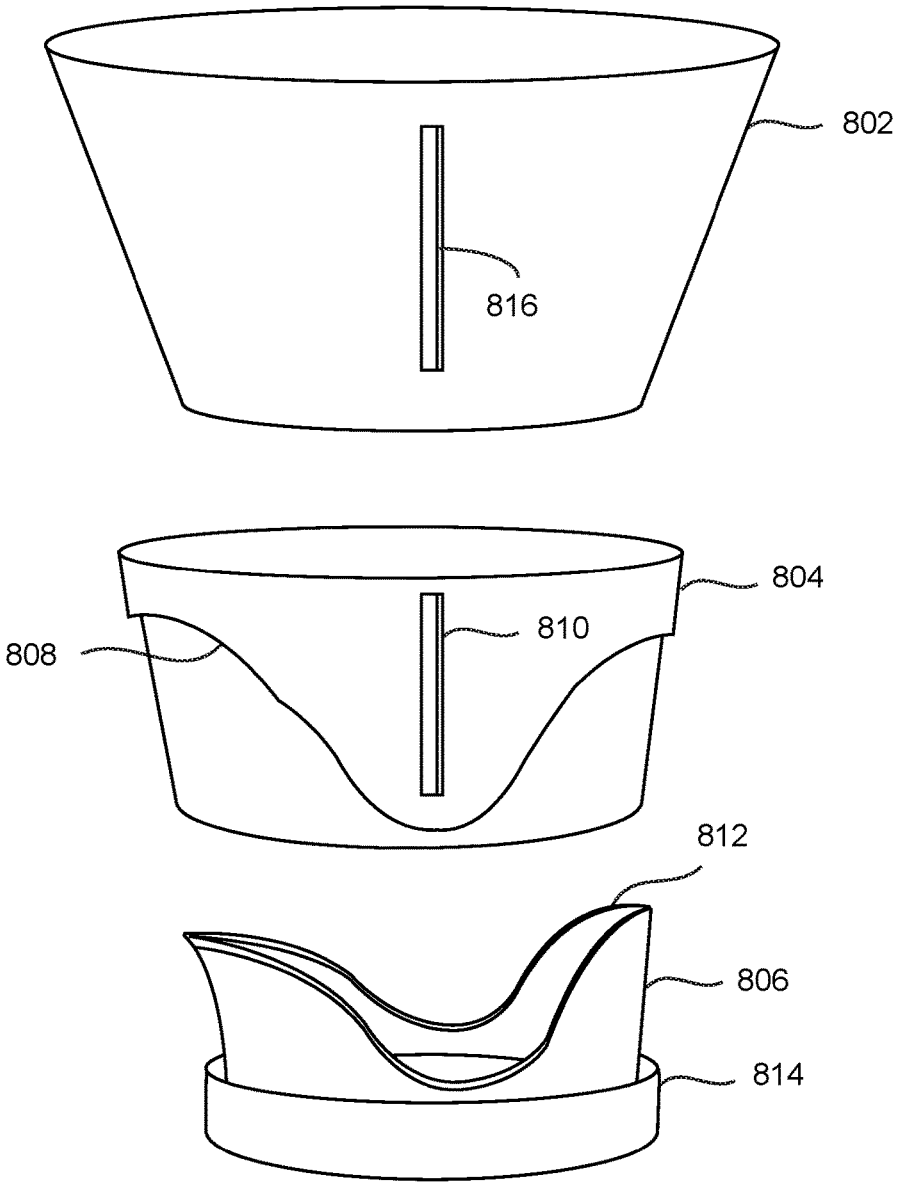
FIG. 8 comprises a partial view in accordance with various embodiments of the invention.

The indents 706. 708, 710 allow the user to selectively put the second container in an elevated position without having to manually hold the container in that position. As the contents of the container are depleted, the user moves the second container up and locks the second container in to the position. When the user needs to move the second container to the next level, the second container is rotated to selectively disengage the tab 712 from the indent 710, for example, and may then move the container up and selectively engage the tab 710 with the another indent such as the second indent or the third indent FIG. 8 illustrates an embodiment in accordance with the disclosure having a first outer container 802, which may or may not have a conical shape as shown, an inner container 804 and a rotating cam portion 806. The rotating cam portion 806 and the inner container 804 reside inside the outer container 802. The inner container 804 has a first cam surface 808 and may have a slot 810. The slot may only protrude into the inner container wall but not though the wall keeping the contents within the container. The first cam surface 808 is variably inclined and engageable with a second cam surface 812 that is complimentary to the first, which is formed as part of the rotating cam portion 806.

The rotating cam portion 806 further comprises a grasp ring 814, coupled thereto which when assembled with the inner container 804 and the outer container 802, accessible from the outside of the outer container 802. This allows the user to grasp the grasp ring 814 and twist or rotate the rotating cam portion 806 to elevate the inner container 804, thereby raising the contents. The grasp ring 814, in this embodiment, does not rise up and down, but stays at the same elevation as it is rotated relative to the outer container. The outer container 802 may also comprise a rail 816, complimentary to the slot 810 to guide the motion of the inner container 804 to the outer container 802, preventing rotation of the two containers (the outer container and the inner container) relative to one another. Other guides may also be envisioned by those of ordinary skill in the art. For example a pin may be configured to engage the slot 810.

Figure 9:
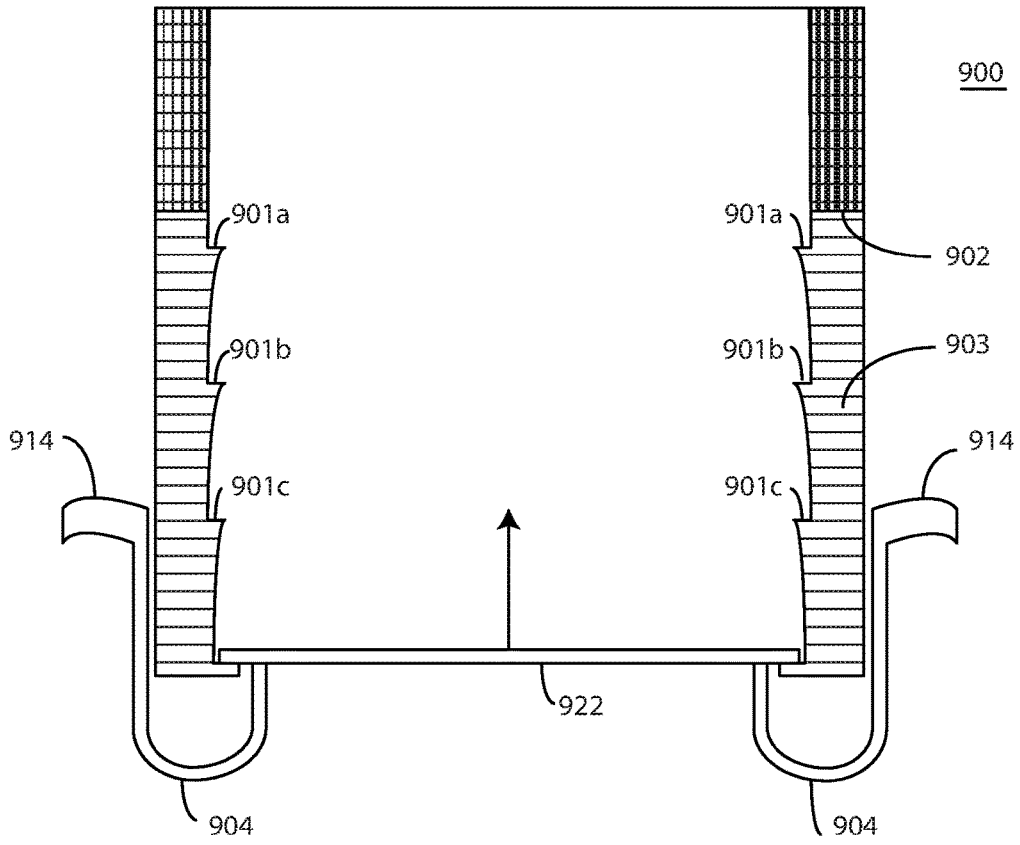
FIG. 9 comprises a front-elevation, cross sectional view as configured in accordance with various embodiments of the invention.
Figure 10:
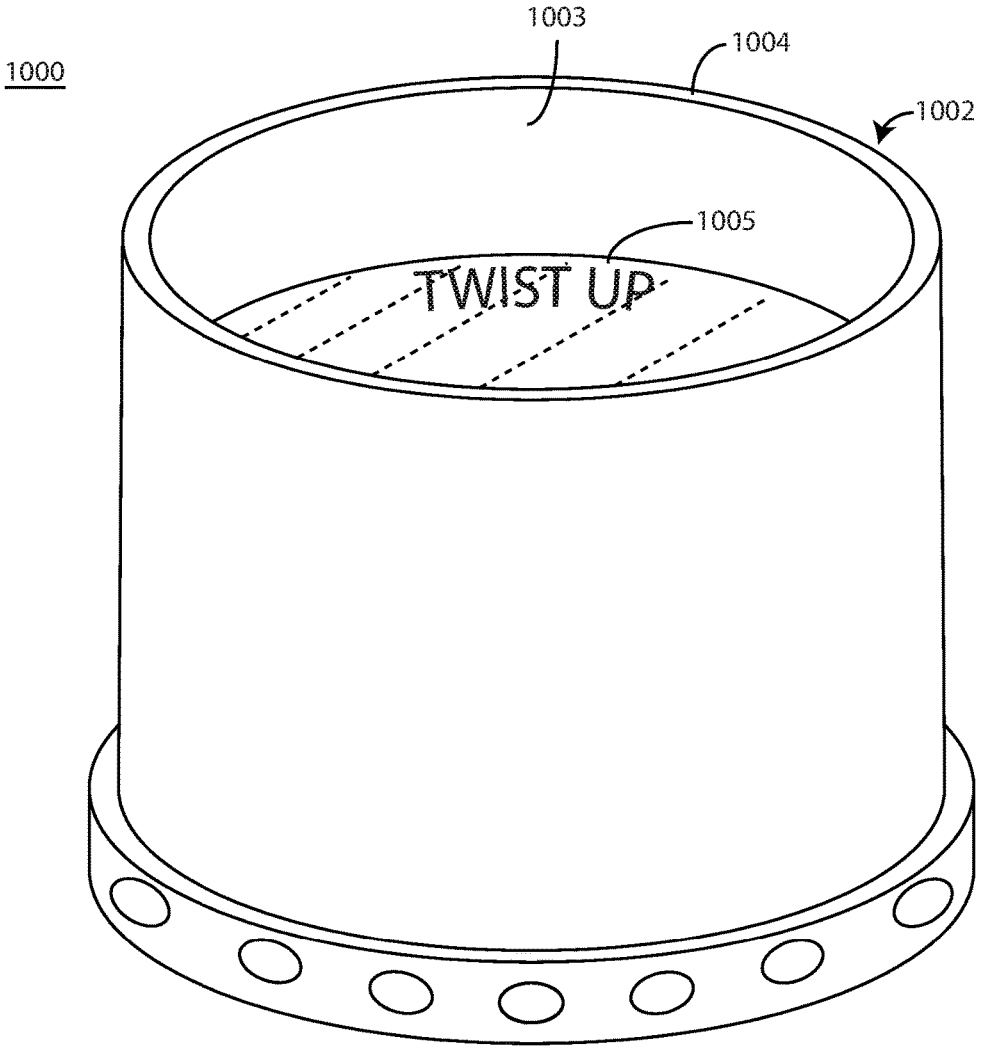
FIG. 10 comprises a perspective view as configured in accordance with various embodiments of the invention.
Figure 11:
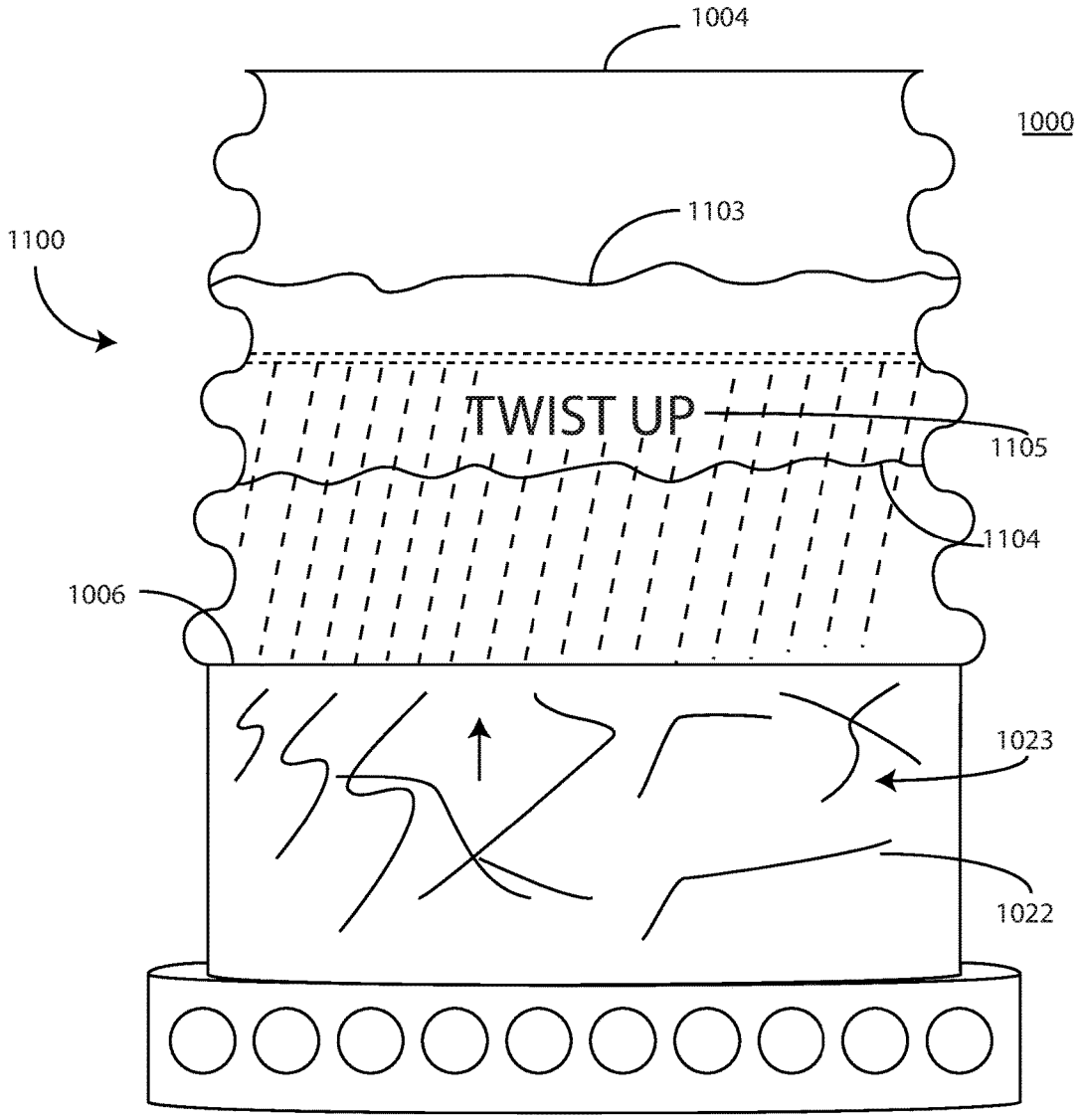
FIG. 11 comprises a front-elevation, cross sectional view in accordance with carious embodiments of the invention.
Figure 12:
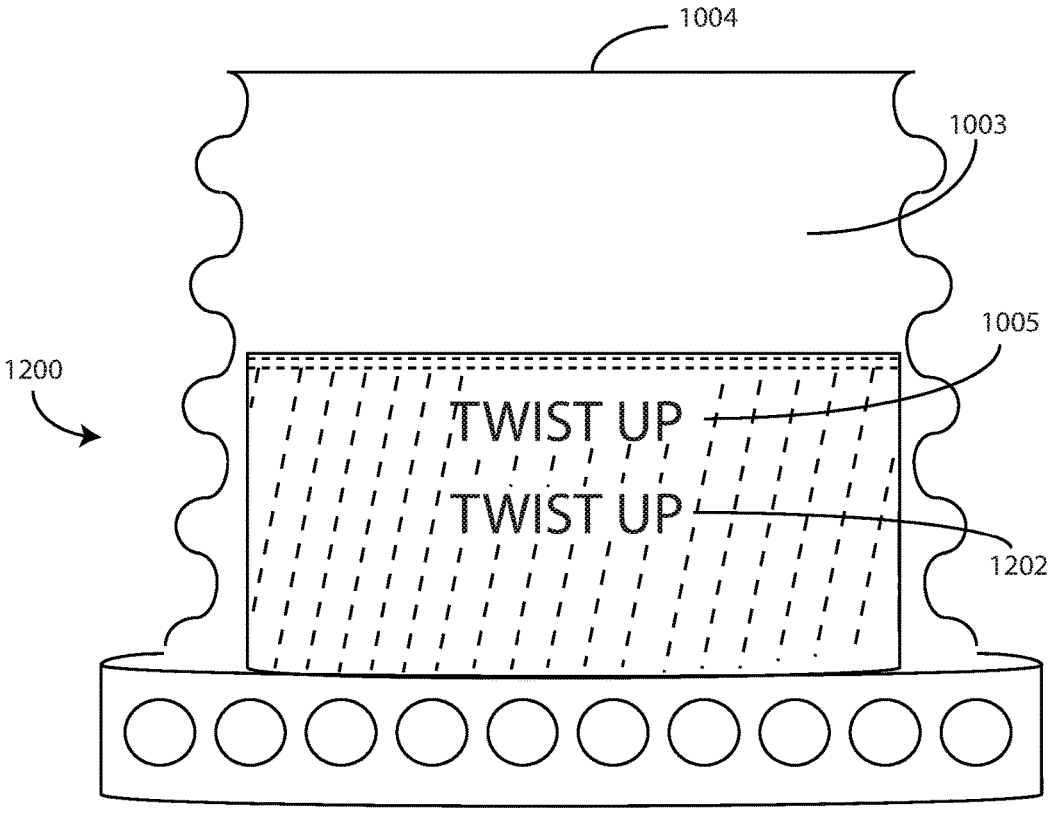
FIG. 12 comprises a front elevation, cross sectional view in accordance with various embodiments of the invention.

FIG. 9 illustrates a cross sectional view of one embodiment wherein internal tabs 901 *a-c*, configured on the inside of the first container 902 engage the second container 922. As the second container 922 is raised, the tabs 901 *a-c* preventing the second container 922 from moving back down to the bottom of the first container 902. In this embodiment the second container 922 may have an outer engagement portion 904 that allows the user to move the second container from outside of the overall container 900. The outer engagement portion 904 couples to a grasp member 914 that resides outside of the container 900. A slot 903 may be formed in the first container 902 to allow the engagement portions 904 to travel up the first container as the second container 922 is moved upward. As with other embodiments, there may be a plurality of engagement portions and complimentary slot; for example there may be three engagement portions and three complimentary slots. FIGS. 10-12 illustrate a user interface to assist the user in determining when to raise the contents within the container 1000. In the various embodiments, there is a user interface comprising an indicator system indicating to the user when the second container 1022 may need to be raised in order to reduce the chance of contents touching the user's hand. As illustrated in FIG. 10, the user interface may comprise indicia 1005 which are marked on the first inner wall 1003 of the first container 1002. The first indicia 1005 is marked on the first inner wall 1003 surface of the first container 1002, the first indicia 1005 vertically positioned a first distance from the top of the container.

The indicia 1005 may be comprised of Indicator lines, shapes, images, shading, coloring or any combination thereof, on the first inner wall 1003. The indicia 1005 are visible to the user indicating that they should raise the second container 1022. In this embodiment, the vertical position of the indicia 1005 along the inner wall 1003 corresponds to the maximum reach-in level. The user depletes the contents, when the indicia 1005 are visible, the user knows to raise the second container 1022.

As further illustrated in FIG. 11, as the contents are depleted and the level has changed from the first content level 1103 to the second content level 1104, the indicia 1005 becomes visible to the user. The container 1000 is illustrated with the second container 1022 in the first position, which is a lowered position. Once the indicia 1005 are readable to the user, the user can follow the instructions indicated by the indicia. For example, in this embodiment the maximum reach-in distance corresponds to the bottom of the words "Twist Up" such that the words are substantially visible before the maximum reach-in distance is met. The indicia 1005 may further be marked on a second inner wall 1023 of the second container 1022 such that when the contents are depleted below the top 1006 of the second container 1022, the user still has an indicator to guide them to twist up the second container 1022. If the maximum reach-in level falls inside the second container 1022 for a particular container system, the indicia 1005 need only be marked on the second inner wall 1023 of the second container 1022.

FIG. 12 also illustrates the container 1000 wherein the second container 1022 is in a second position 1200, which is a raised position, such that the indicia 1005 on the first inner wall 1003 of the first container 1002 are now covered by the walls of the second container 1002. A second set of Indicia 1202 may be marked on the second inner walls 1023 of the second container 1022 so that as the contents are further removed form the container, the user is reminded to continue to "twist up" the second container 1022. This is done until the second container 1022 reaches the top 1004.

Figure 13:
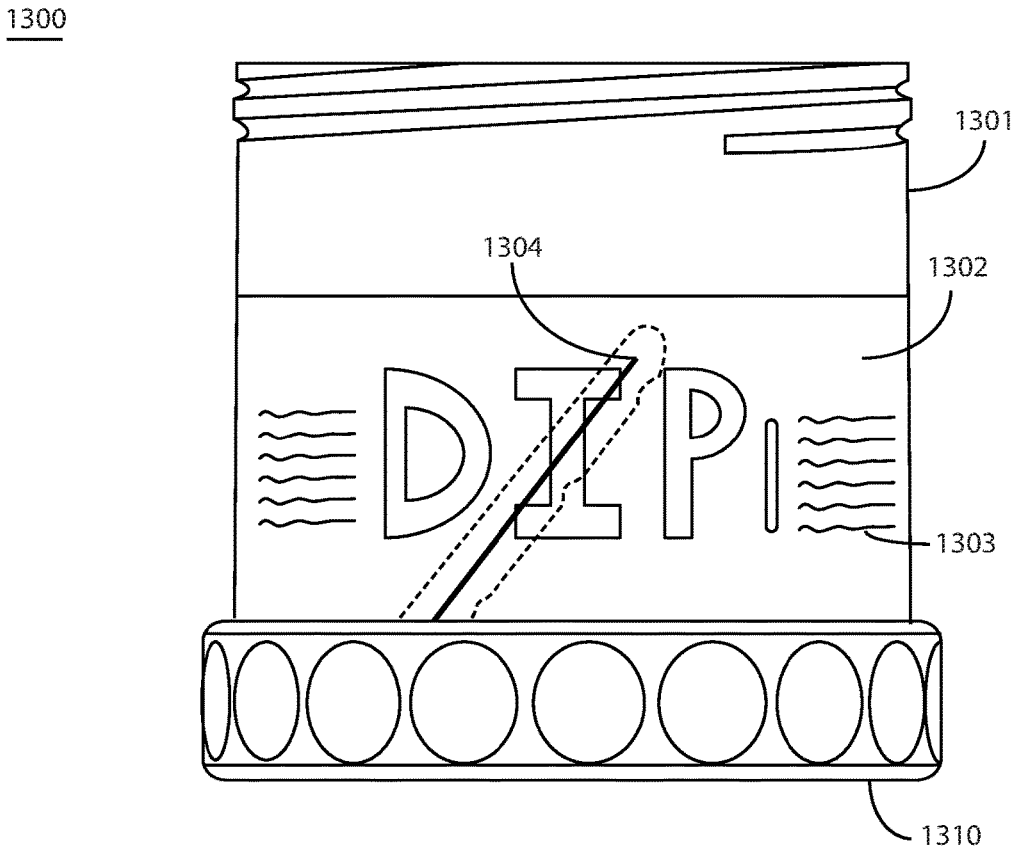
FIG. 13 comprises a front elevation view in accordance with various embodiments of the invention.

FIG. 13 illustrates a container 1300 wherein the container has a label 1302 on the outer surface of the first container 1301. The label as product information 1303 and may further have decorative marketing. The label 1302, in this embodiment, covers the container surface as well as the slots

1305 (shown in broken line). The label 1302 has a slit 1304 that allows the tabs of the second container (not shown here) to extend through and couple to the grip ring 1310 while maintaining an esthetically pleasing outer surface of the container 1300. As the tabs are moved upward, the slit may spread around the tabs.

Figure 14:
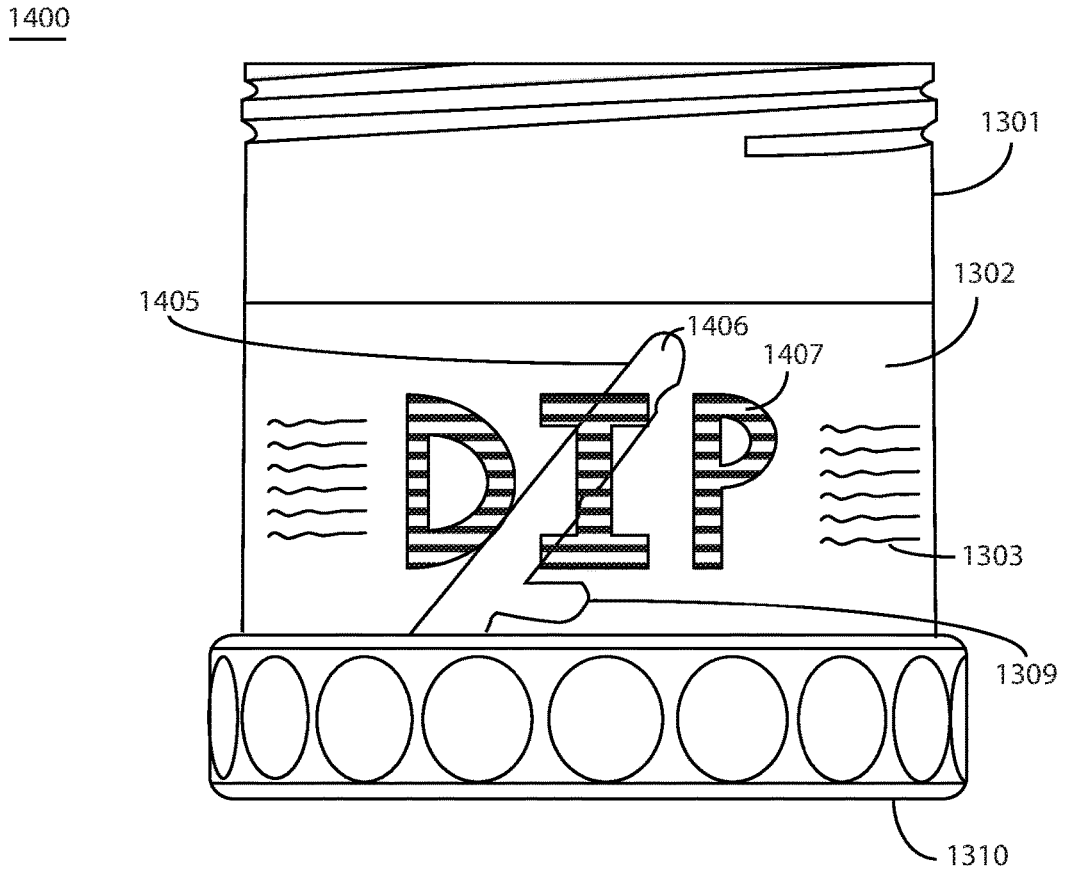
FIG. 14 comprises a front elevation view in accordance with various embodiments of the invention.

FIG. 14 illustrates a container 1400 wherein the container has a first label 1302 on the outer surface of the first container 1301. The label 1302 may cover the container 1301 surface and has an opening that is complimentary to the slots 1405 such that the second container 1406 is visible through the slot 1405. The label may be an additional element covering the container or as an example, may be printed or painted directly on the container. The second container 1406 may further have additional labeling 1407 that is complimentary to the first label 1302. In other words, the esthetics of the first label pass through to the second label 1407, providing an esthetically pleasing look to the user, hiding or camouflaging the slot, while allowing the slots 1405 to be present in the second container 1301. For example, the word "DIP" is completed by the first label 1302 and the second additional label 1407.

Other markings are indicia may be places on the second container outer surface 1406 so that when the second container is rotated, other esthetically pleasing looks are visible through the slot. The second container outer surface 1406 may also have indicia to indicate the level the second container is raised to. As with the other embodiment, a plurality of tabs and slots may be employed. Further the material used to make the labeling may be known to those having ordinary skin in the art. The various embodiments provide a configuration that allows the user to raise the contents within the container without lifting the overall container or reaching into container to effectuate the raising of the contents.

Figure 15A:
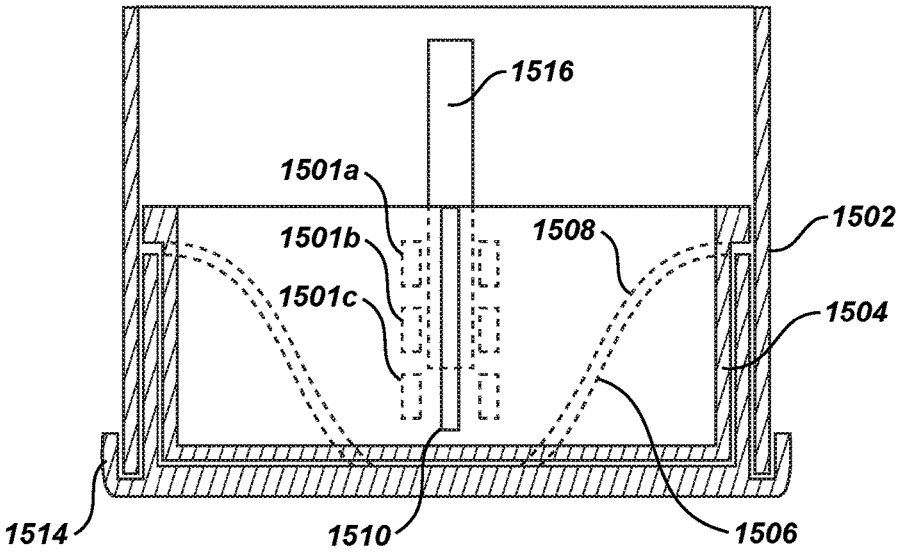
FIG. 15A comprises a front-elevation, cross sectional view as configured in accordance with various embodiments of the invention.

FIG. 15A illustrates an embodiment in accordance with the disclosure having a first outer container 1502, which may have a cyclindrical shape as shown or some other shape, an inner container 1504 and a rotating cam portion 1506. The rotating cam portion 1506 and the inner container 1504 reside inside the outer container 1502. The inner container 1504 has a first cam surface 1508 and may have a slot 1510. The slot may only protrude into the inner container wall but not though the wall keeping the contents within the container. The first cam surface 1508 is variably inclined and engageable with a second cam surface 1512 that is complimentary to the first, which is formed as part of the rotating cam portion 1506.

Figure 15B:
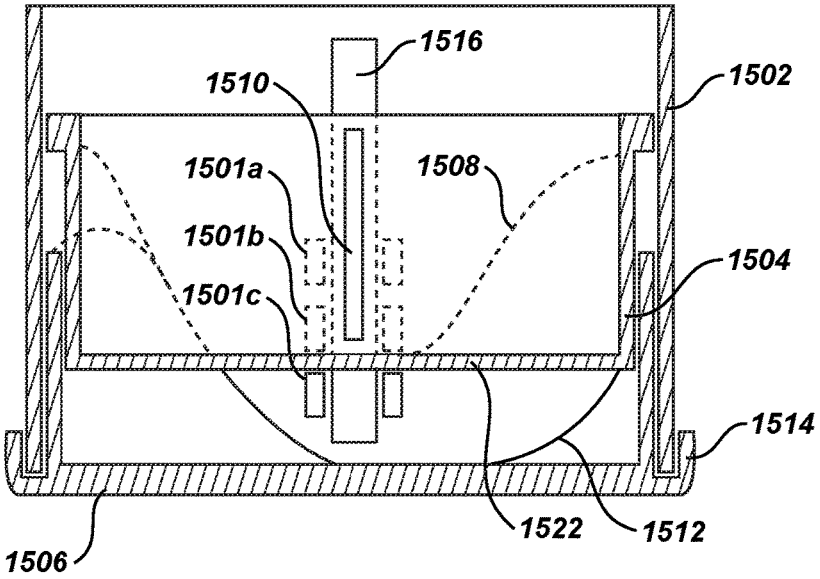
FIG. 15B comprises a front-elevation, cross sectional view in accordance with the embodiment of FIG. 15A with the cam portion having been rotated.

As illustrated in FIG. 15B, the rotating cam portion 1506 further comprises a grasp ring 1514, coupled thereto which when assembled with the inner container 1504 and the outer container 1502, accessible from the outside of the outer container 1502. This allows the user to grasp the grasp ring 1514 and twist or rotate the rotating cam portion 1506 to elevate the inner container 1504, thereby raising the contents. FIG. 15B shows the cam portion having been rotated by some amount less than 90 degrees, or more specifically, approximately 30 degrees. The inner container 1504 is thereby raised relative to the outer container 1502 by action of the first cam surface 1508 against the second cam surface 1512 as illustrate in FIG. 15B. The grasp ring 1514, in this embodiment, does not rise up and down, but stays at the same elevation as it is rotated relative to the outer container. The outer container 1502 may also comprise a rail 1516, complimentary to the slot 1510 to guide the motion of the inner container 1504 to the outer container 1502, preventing rotation of the two containers (the outer container and the inner container) relative to one another. Other guides may also be envisioned by those of ordinary skill in the art. For example a pin may be configured to engage the slot 1510.

In further reference to FIGS. 15A-B, internal tabs 1501 *a-c* are configured on the inside of the first, outer container 1502. As the inner container 1504 is raised relative to the outer container 1502, the tabs 1501 sequentially engage the bottom 1522 of the second, inner container 1504, starting with tabs 1501*c* and proceding to 1501*b* and 1501*a* as the inner container is raised. The tabs 1501 *a-c* prevent the second container 1504 from moving back down to the bottom of the first container 1502.

While the embodiments of the invention show twisting or upward movement to raise the contents, other motions including a downward motion of the grasp ring for example may be employed. The rotational grasp ring may be present at the top of the container 100 or the grasp ring may be sized such that is substantially the entire height of the container 100.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

What is claimed is:

1. A container for dispensing contents, the container comprising:

a first container portion comprising: an opening to access the contents, a first container portion top, a first container portion bottom, a first container portion inner surface, and a first container portion outer surface;

a second container portion to contain at least a portion of the contents, the second container portion comprising: a second container portion top, a second container portion bottom, a second container portion inner surface, a second container portion outer surface, and a cam surface;

a tab extending inwardly from the first container portion inner surface and engaging the second container portion; and a rotating cam portion, rotatably engaged with the cam surface, the rotating cam portion comprising a grasp ring;

the second container portion encompassed by the first container portion and forming an internal chamber within the first container portion; and the second container portion movable relative to the first container portion between the first container portion bottom and the first container portion top to elevate at least some of the contents contained within the second container portion;

wherein as the second container portion is elevated from the first container portion bottom toward the first container portion top, the tab engages the second container portion bottom, preventing the second container portion from moving downward beyond the tab toward the first container portion bottom.

2. The container of claim 1, wherein the cam surface extends from the second container portion outer surface toward the first container portion inner surface.

3. The container of claim 1, wherein at least some of the rotating cam portion is encompassed by the first container portion.

4. The container of claim 1, the grasp ring accessible exterior to the first container portion outer surface.

5. The container of claim 1, the grasp ring coupled to the rotating cam portion and extending beyond the first container portion outer surface.

6. The container of claim 5, the grasp ring extending distally from the first container portion beyond the first container portion bottom.

7. The container of claim 1, a first one of the first container portion inner surface or the second container portion outer surface comprising a slot.

8. The container of claim 7, a second one of the first container portion inner surface or the second container portion outer surface other than the first one of the first container portion inner surface or the second container portion outer surface comprising a guide complimentary to and engaged with the slot.

9. The container of claim 1, further comprising a seal disposed between the second container portion and the first container portion.

10. The container of claim 9, the seal disposed between the second container portion outer surface and the first container portion inner surface.

11. The container of claim 9, the seal coupled to and disposed about a perimeter of the second container portion outer surface.

12. The container of claim 11, the seal disposed at the second container portion top adjacent the opening.

13. The container of claim 1, the first container portion having a first height, the second container portion having a second height, the first container height about one and one half times the second height.

14. The container of claim 1, the first container portion having a first container portion inner diameter and a maximum reach in distance.

15. The container of claim 14, a ratio of the first container portion inner diameter to the maximum reach in distance between 4;0 and 2.6, inclusive.

* * * * *